US009822630B2

(12) United States Patent
Ring et al.

(10) Patent No.: US 9,822,630 B2
(45) Date of Patent: Nov. 21, 2017

(54) MARINE DIVERTER SYSTEM WITH REAL TIME KICK OR LOSS DETECTION

(71) Applicant: Weatherford Technology Holdings, LLC, Houston, TX (US)

(72) Inventors: Lev Ring, Houston, TX (US); Don M. Hannegan, Fort Smith, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 13 days.

(21) Appl. No.: 14/710,790

(22) Filed: May 13, 2015

(65) Prior Publication Data

US 2015/0330205 A1 Nov. 19, 2015

Related U.S. Application Data

(60) Provisional application No. 61/992,755, filed on May 13, 2014.

(51) Int. Cl.
*E21B 21/01* (2006.01)
*E21B 21/08* (2006.01)
(Continued)

(52) U.S. Cl.
CPC ..... *E21B 47/0001* (2013.01); *E21B 15/02* (2013.01); *E21B 17/01* (2013.01);
(Continued)

(58) Field of Classification Search
CPC .... E21B 19/004; E21B 19/006; E21B 21/001; E21B 21/08; E21B 33/085; E21B 47/0001; E21B 47/10
See application file for complete search history.

(56) References Cited

U.S. PATENT DOCUMENTS 3,910,110 A 10/1975 Jefferies et al.
3,976,148 A 8/1976 Maus et al.
(Continued)

FOREIGN PATENT DOCUMENTS

CA 2634937 A1 6/2009
EP 0498128 A1 8/1992
(Continued)

OTHER PUBLICATIONS

Australian Examination Report dated Jun. 3, 2016 for AU Patent Application No. 2015202590, 5 pages.
(Continued)

*Primary Examiner* — Matthew R Buck
(74) *Attorney, Agent, or Firm* — Smith IP Services, P.C.

(57) ABSTRACT

The disclosure relates to a system and method for determining whether a kick or loss has occurred from a well in real time, wherein the well has a marine diverter having a rotating control device. The marine diverter system may measure flow rate in real time of a drilling fluid entering the wellbore and provide a means of measuring flow rate of the drilling fluid out of the wellbore and riser. The marine diverter system may further determine displacement and velocity of displacement of rig heave motion in real time and use the foregoing steps, given a known internal diameter of the riser and a known external diameter of a drill pipe, and employing a drilling fluid volume balance equation: (Volumetric flow rate-in)−(Volumetric flow rate-out)−(Change in riser annular Volume per unit time)=X, to determine whether the kick or loss has occurred in real time.

21 Claims, 10 Drawing Sheets

(51) Int. Cl.

| | |
|---|---|
| ***E21B 47/00*** | (2012.01) |
| ***E21B 15/02*** | (2006.01) |
| ***E21B 17/01*** | (2006.01) |
| ***E21B 19/00*** | (2006.01) |
| ***E21B 47/10*** | (2012.01) |
| ***E21B 33/08*** | (2006.01) |
| ***E21B 21/00*** | (2006.01) |
| ***E21B 33/076*** | (2006.01) |

(52) U.S. Cl.
CPC ..... *E21B 19/004* (2013.01); *E21B 21/001* (2013.01); *E21B 21/08* (2013.01); *E21B 33/076* (2013.01); *E21B 33/085* (2013.01); *E21B 47/10* (2013.01)

(56) References Cited

U.S. PATENT DOCUMENTS

| | | | | |
|---|---|---|---|---|
| 4,282,939 | A * | 8/1981 | Maus | E21B 21/08 175/48 |
| 4,326,584 | A * | 4/1982 | Watkins | E21B 33/085 166/84.2 |
| 4,527,425 | A * | 7/1985 | Stockton | E21B 21/08 175/48 |
| 5,168,932 | A * | 12/1992 | Worrall | E21B 21/001 166/336 |
| 5,178,215 | A * | 1/1993 | Yenulis | E21B 34/16 166/95.1 |
| 5,251,869 | A * | 10/1993 | Mason | E21B 33/085 251/1.1 |
| 5,277,249 | A * | 1/1994 | Yenulis | E21B 34/16 166/84.3 |
| 5,279,365 | A * | 1/1994 | Yenulis | E21B 34/16 166/84.3 |
| 6,230,824 | B1 | 5/2001 | Peterman et al. | |
| 6,278,937 | B1 | 8/2001 | Ishida et al. | |
| 6,352,120 | B1 * | 3/2002 | Carbaugh | E21B 33/08 166/180 |
| 6,450,262 | B1 * | 9/2002 | Regan | E21B 21/001 166/350 |
| 6,470,975 | B1 * | 10/2002 | Bourgoyne | E21B 21/001 166/367 |
| 7,159,669 | B2 * | 1/2007 | Bourgoyne | E21B 23/006 166/348 |
| 7,997,345 | B2 * | 8/2011 | Hannegan | E21B 33/085 166/345 |
| 8,347,982 | B2 | 1/2013 | Hannegan et al. | |
| 2003/0106712 | A1 | 6/2003 | Burgoyne et al. | |
| 2005/0236158 | A1 | 10/2005 | Miyahara | |
| 2009/0161997 | A1 | 6/2009 | Beauchamp et al. | |
| 2011/0024195 | A1 * | 2/2011 | Hoyer | E21B 21/00 175/65 |
| 2011/0315404 | A1 | 12/2011 | Bailey et al. | |
| 2014/0027129 | A1 | 1/2014 | Hannegan et al. | |
| 2014/0069720 | A1 | 3/2014 | Gray | |

FOREIGN PATENT DOCUMENTS

| | | | | |
|---|---|---|---|---|
| GB | 2081343 | A | 2/1982 | |
| SG | WO 2011128690 | A1 * | 10/2011 | E21B 33/06 |
| WO | 2013037049 | A1 | 3/2013 | |
| WO | 2014055090 | A1 | 4/2014 | |
| WO | WO 2014105043 | A1 * | 7/2014 | E21B 33/085 |

OTHER PUBLICATIONS

European Search Report dated Nov. 2, 2015 for EP Patent Application No. 15167690.5, 9 pages.
GE Oil & Gas, 2011, "Hydril Pressure Control FS™21" 500-psi Marine Riser Diverter", product specification brochure, 2 pages.
Weatherford U.S., L.P., 2009, "9000 RCD in Marine Diverter Adapter", Drawing No. D000359787, 1 page.
Weatherford U.S., L.P., 2010, "21-1/4"—10,000 RCD W/Stinger", Drawing No. SK01137, 1 page.
Australian Patent Examination Report dated Sep. 1, 2016 for AU Patent Application No. 2015202590, 7 pages.
Search Report dated Dec. 8, 2016 in European Patent Application 16 17 1810, 14 pages.

* cited by examiner

MARINE DIVERTER SYSTEM WITH REAL TIME KICK OR LOSS DETECTION

BACKGROUND

Technical Field

The subject matter generally relates to systems in the field of oil and gas operations wherein a marine diverter having a sealing element is located above a telescopic joint.

U.S. Patent Nos., and Publication Nos. U.S. Pat. Nos. 7,997,345; 6,470,975; 5,205,165; 8,347,983; WO2013/037049; U.S. Pat. Nos. 3,976,148; 4,440,239; 8,347,982; 4,626,135; and a paper entitled "Real Time Data from Closed Loop Drilling Enhances Offshore HSE" from WORLD OIL, published March 2013, at pgs. 33-42 are incorporated herein by reference for all purposes in their respective entireties. Each and every patent, application and/or publication referenced within each respective referenced patent is also incorporated herein by reference for all purposes in its respective entirety.

For the referenced U.S. Pat. No. 7,997,345, the RCD is above the marine diverter, which is bolted to the bottom of the drilling rig rotary table beams. The height of the I-beams (distance from diverter top to bottom of rotary table) differs from drilling rig to drilling rig, but in most cases, having the RCD within that height interferes with tools usually set in the rotary table (e.g. slips, tongs, bushings, etc.).

BRIEF SUMMARY

The disclosure relates to a system and method for determining whether a kick or loss has occurred from a well in real time in the oilfield industry, wherein the well has a marine diverter having a rotating control device assembly (or RCD). The rotating control device may include a bearing assembly and seal(s) suspended inside and fixed relative to the marine diverter body. Further, the RCD assembly may be located above a riser telescopic joint and a packer seal. The packer seal may have a first position wherein the packer seal is open and a second position wherein the packer seal is closed on an outer body of or connected to the RCD assembly to provide pressure sealing between an interior and an exterior of a riser. The marine diverter system may measure flow rate in real time of a drilling fluid entering the wellbore and provide a means of measuring flow rate of the drilling fluid out of the wellbore and riser into a mud rig system. The marine diverter system may further determine displacement and velocity of displacement of rig heave motion on a drilling rig in real time and use the foregoing process or steps, given a known internal diameter of the riser and a known external diameter of a drill pipe, and employing a drilling fluid volume balance equation: (Volumetric flow rate-in)−(Volumetric flow rate-out)−(Change in riser annular Volume per unit time)=X, to determine whether the kick or loss has occurred in real time.

As used herein the terms "determining" or "determine" shall also refer to modelling or otherwise calculating, computing, detecting, inferring, deducing and the like, in particular of a condition, quality or aspect of a wellbore unless otherwise expressly excluded or limited elsewhere herein. Similarly, as used herein the term "measuring" or "measure" shall also refer to modelling unless otherwise expressly excluded or limited elsewhere herein.

As used herein the terms "kick-loss", "kick/loss" or "kick or loss" are used interchangeably within the disclosure and shall refer to any entry or influx, or loss of formation fluid into the wellbore during drilling operations, or any abnormal pressure or fluid fluctuations or changes in the wellbore and the like.

BRIEF DESCRIPTION OF THE FIGURES

The exemplary embodiments may be better understood, and numerous objects, features, and advantages made apparent to those skilled in the art by referencing the accompanying drawings. These drawings are used to illustrate only typical exemplary embodiments of this invention, and are not to be considered limiting of its scope, for the invention may admit to other equally effective exemplary embodiments. The figures are not necessarily to scale and certain features and certain views of the figures may be shown exaggerated, in scale, or in schematic in the interest of clarity and conciseness.

DETAILED DESCRIPTION OF THE EXEMPLARY EMBODIMENT(S)

The description that follows includes exemplary apparatus, methods, techniques, and instruction sequences that embody techniques of the inventive subject matter. However, it is understood that the described exemplary embodiments may be practiced without these specific details.

FIGS. 1-4*b* depict schematic views of a marine diverter MD proximate a drilling rig DR above the surface of the water at a marine well site. In such a system, limited space or clearance may exist between the marine diverter MD and tools/components forming part of or emanating from the rotating table. Such limited space may prohibit or quantify the available clearance for the mounting of a rotating control device (RCD) 10 to the top of the marine diverter MD. Moreover, during rig heave and given a telescopic tubular joint 80 to compensate for heave, upward relative heave will cause a decrease in flow-out volume over time through the marine diverter MD, and downward relative heave will cause an increase in flow-out volume over time through the marine diverter MD above a telescopic tubular joint 80.

Figure 1:
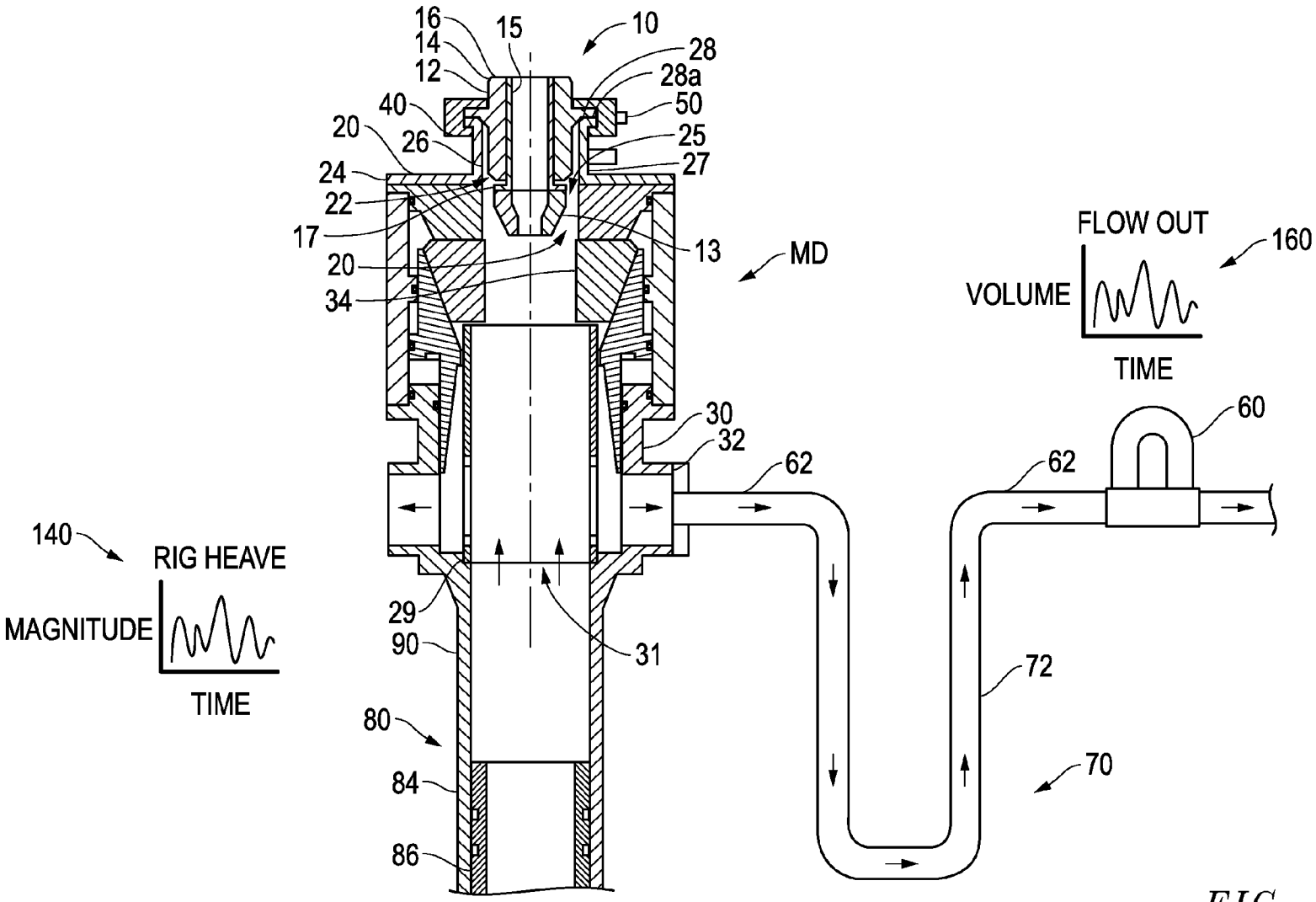
FIG. 1 depicts a schematic view of an embodiment of a marine diverter system, also including a graph or plot of heave magnitude/time and a graph of flow-out volumes/time.
Figure 1A:
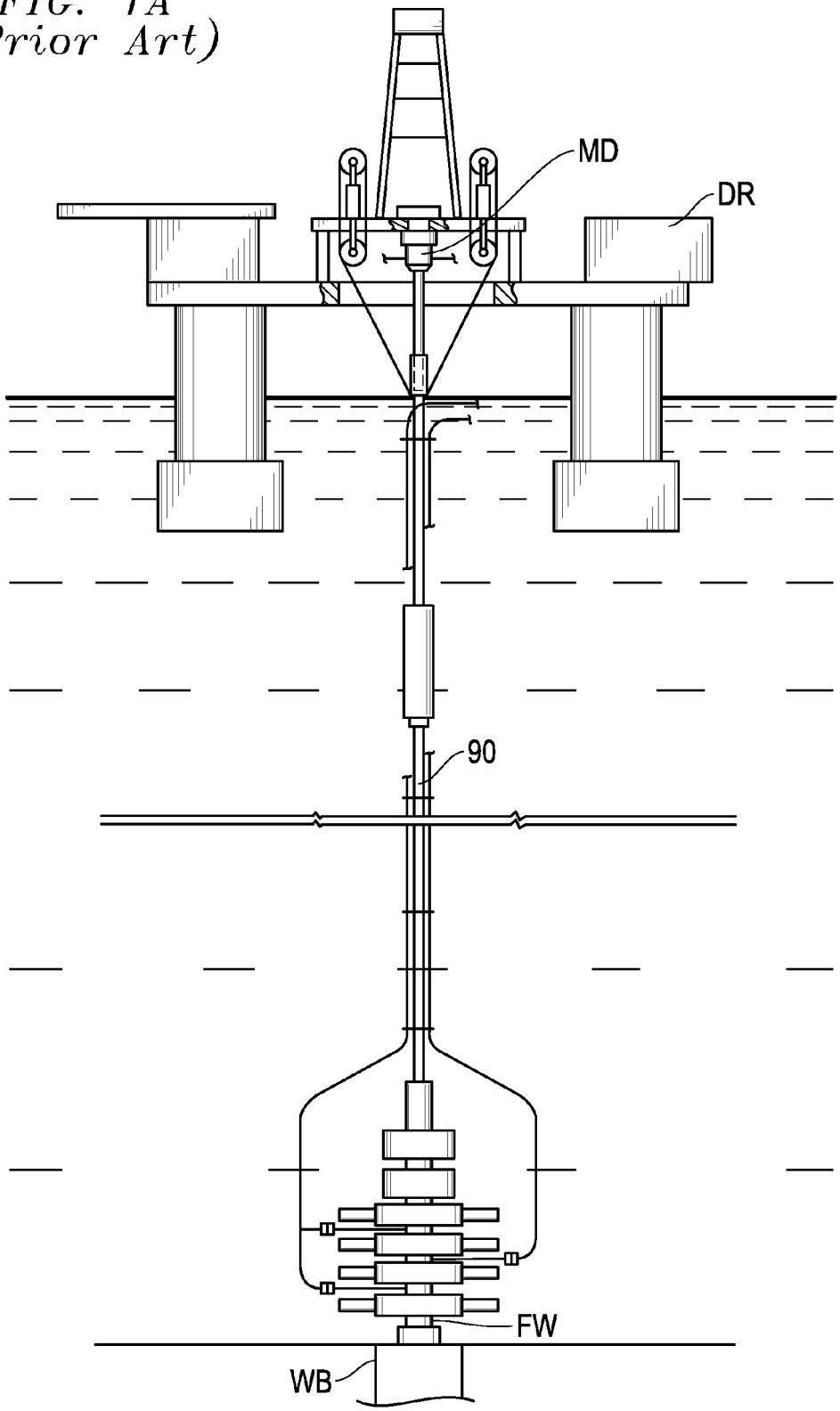
FIG. 1A (Prior Art)
FIG. 1A depicts an elevational view of an exemplary embodiment of a floating drilling rig showing a blowout preventer stack on the ocean floor, a marine riser, a subsurface annular blowout preventer marine diverter, and an above surface diverter.
Figure 1B:
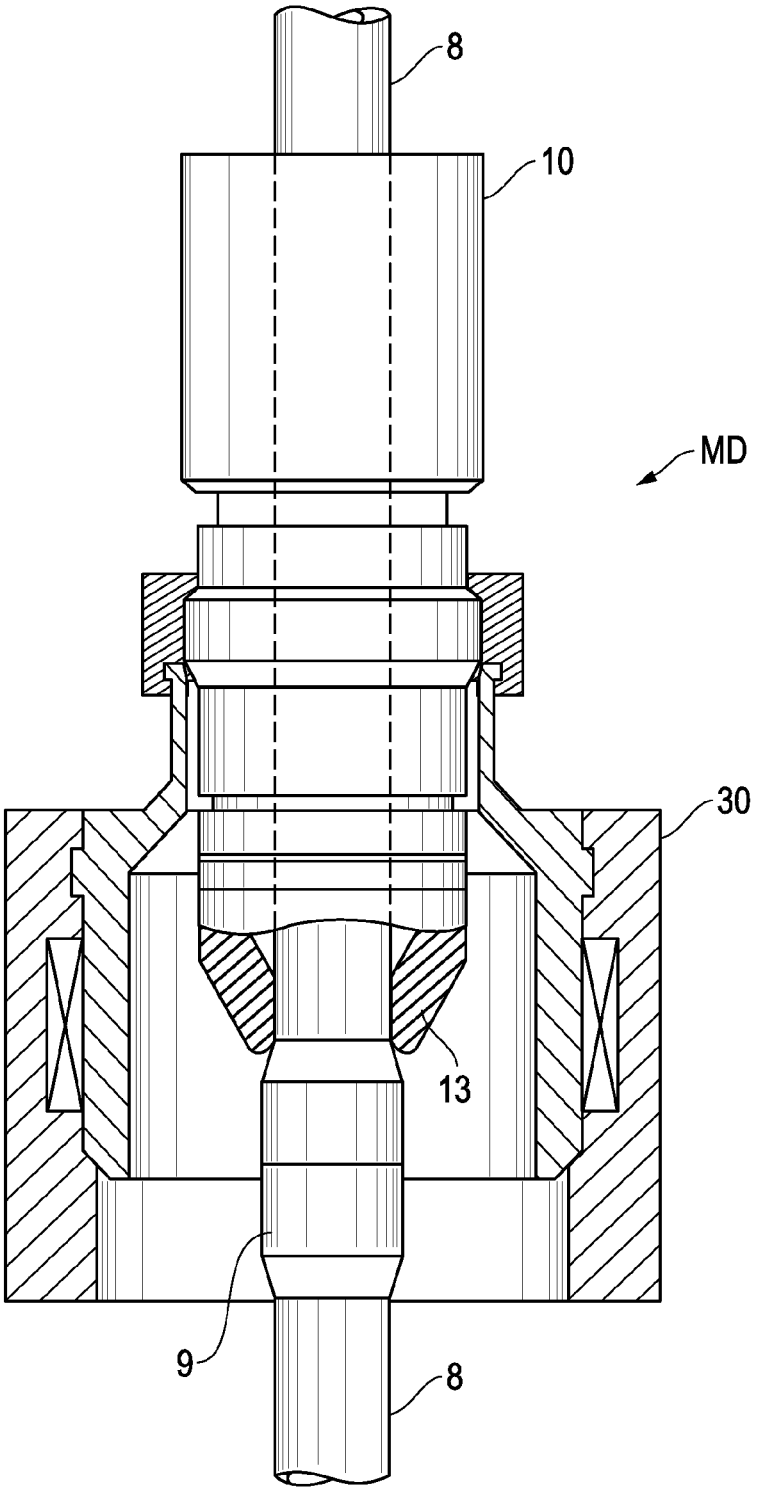
FIG. 1B (Prior Art)
FIG. 1B depicts a cut away section elevational view of a marine diverter system shown in section.

FIG. 1A depicts an elevational view of an exemplary embodiment of a floating drilling rig DR showing a blowout preventer (BOP) stack on the ocean floor, a marine riser 90, and a marine diverter MD. The BOP stack is positioned on the ocean floor over the well-head FW and the wellbore WB. FIG. 1B depicts a cut away section elevational view of a marine diverter MD system shown in section. The drill string or drill pipe 8 is inserted through the RCD 10 so that tool joint 9 supports RCD 10 and its housing by the RCD 10 lower stripper rubber 13 as the RCD 10 is run into the marine housing 30.

An additional reason to drill with a closed marine diverter MD system is in the exemplary scenario in the presence of risk of abnormal pressure zones where a surprise kick (e.g. shallower than one would expect) may get past the subsea blowout preventer (or BOP) and into the marine riser 90 before the rig crew may have time to implement secondary well control by closing the BOP. The 'abnormal pressure risk' is not that normally associated with what is known as a 'shallow gas hazard' and is usually encountered on fixed offshore rigs and platforms when drilling in shallow gas fields. Instead, on floaters, the 'abnormal pressure risk' may be associated with migration of gas along a fault line to shallower depths or a gas pocket (such as, for example, taught at http://www.geophysicsrocks.com/our-technology/technology-at-work/drill-oil/shallow-hazard-example/ which is incorporated herein by reference). Here, the value of the subject exemplary embodiments would be quick detection of well flow and where modest amounts (less than 500 psi or pounds per square inch) of surface back pressure applied immediately may suppress flow, buying time to add mud weight, and/or access whether or not the kick could be circulated out safely with a dynamic kill (hydrostatic pressure and pump rate friction pressure). A candidate for drilling ahead with a closed marine diverter MD system would be one where the operator or regulatory may have doubts about the ability to detect such a drilling hazard via a pre-drill seismic risk analysis (such as, for example, a pre-drill seismic risk analysis to detect shallow subsurface geologic hazards such as faults, gas charged sediments, buried channels, and abnormal pressure zones.

FIGS. 1-4*b* depict a system and method for determining whether a kick or loss has occurred from a well or wellbore WB in real time in the oilfield industry, wherein the well has a marine diverter MD having a rotating control device assembly (or RCD) 10. The rotating control device 10 may include a bearing assembly 12 and a seal(s) 13 suspended inside and fixed relative to the marine diverter body MD. Further, the RCD assembly 10 may be located above a riser telescopic joint 80 and a packer seal 34. The packer seal 34 may have a first position wherein the packer seal 34 is open and a second position wherein the packer seal 34 is closed on an outer body of or connected to the RCD assembly 10 to provide pressure sealing between an interior and an exterior of a riser 90. The telescopic joint 80 may include an outer barrel 84 and an inner barrel 86. The marine diverter MD system may also include a pressure transducer 52.

The marine diverter MD system may measure flow rate in real time of a drilling fluid entering the wellbore WB and provide a means of measuring flow rate of the drilling fluid out of the wellbore WB and riser into a mud rig system. The marine diverter MD system may further determine displacement and velocity of displacement of rig heave motion on a drilling rig DR in real time and use the foregoing process or steps, given a known internal diameter of the riser 90 and a known external diameter of a drill pipe 8, and employing a drilling fluid volume balance equation: (Volumetric flow rate-in)−(Volumetric flow rate-out)−(Change in riser annular Volume per unit time)=X, to determine whether the kick or loss has occurred in real time. The step of determining whether the kick or loss has occurred in real time includes determining whether the modified volumetric flow balance, or X, does or does not equal zero.

In addition, the marine diverter MD system may plot a magnitude or height of marine heave on a drilling rig DR according to real time for creating a graph 140 of rig heave. The marine diverter MD system may also plot a flow volume according to real time for creating a graph 160 of flow out. The plotting of a magnitude or height of the marine heave according to real time and the plotting of flow volume according to real time may be correlated (or the graphs 140, 160 overlaid over each other) to determine whether the kick or loss has occurred in real time.

The FIGS. 1-4*b* also depict an apparatus for use in the oilfield industry with a drilling rig DR having a riser 90 extending from a marine body with a drill pipe 8 configured to move within the riser 90 and the marine diverter MD and a telescopic tubular joint 80 below the marine diverter MD. The marine diverter MD may include a marine housing 30 with a diverter outlet 32 that is connected to the drilling rig DR and the riser 90 above the telescopic tubular joint 80. An annular packer seal 34 mounted or inserted in the marine housing 30 may be configured to close on a tubular (such as the drill pipe 8 inclusive of or a tool joint 9). The marine diverter MD system may also include a bearing assembly 12 configured for insertion into a passageway 25 into the marine diverter MD, and an assembly for fastening 40. The bearing assembly 12 may include an outer race 14, a rotatable inner race 15 and one or more rotatable seal(s) 13 connected to the rotatable inner race 15, wherein the rotatable seal(s) 13 can rotate against the drill pipe 8 under a differential pressure. The assembly for fastening 40 may connect the marine diverter MD to the bearing assembly 12 configured to maintain the bearing assembly 12 oriented axially with the drill pipe and the riser 90. The annular packer seal 34 may be configured to selectively close and seal against the outer race 14 of the bearing assembly 12, while the inner race 15 of the bearing assembly 12 is allowed to rotate along with the rotatable seal(s) 13 and the drill pipe 8.

The marine diverter MD system may further include a device 50 mounted to or in communication with any fixed portion of the drilling rig DR, wherein the device 50 may be configured to measure vertical displacement of the marine diverter MD. The device 50 may be, by way of example only and not limited to, a gyro accelerometer, a linear accelerator, a GPS device/system, or an optical laser. The device 50 may be mounted or in communication with the drilling rig DR (such as, proximate to the marine diverter MD). A flow meter 60 may be mounted to a diverter flow line 62 connected to the marine housing 30;

The marine diverter MD system may detect a kick or loss from a well WB in the oilfield industry, by acquiring data from a device 50 which is configured to measure vertical displacement of the marine diverter MD proximate a marine diverter MD and interpreting the data acquired from the device 50 as a first representation 140 of height or magnitude over time of marine heave. Subsequently, data may be acquired from a flow meter 60 proximate the marine diverter MD and at least partially downstream of a telescoping slip joint 80 and interpreting the data acquired from the flow meter 60 for determining a second representation 160 of changes in volumetric flow over time downstream of a telescoping slip joint 80. Then, the first representation 140 may be compared to the second representation 160 in order to detect whether a kick or loss has occurred from a well WB. Alternatively, the data interpreted as a height over time of marine heave and the data interpreted as change in volumetric flow may be compared to detect whether a kick or loss has occurred without having a first and/or second representation of the respective data.

The FIGS. 1-4*b* also depict an apparatus for use with a marine diverter MD in the oilfield industry and includes a marine housing 30 having a diverter outlet 32, a diverter seal insert 20, wherein the diverter seal insert 20 has an annulus 22 (or a bearing assembly adaptor 22, as the case may be), which has an outer surface 24 and an inner surface 26 that defines a passageway 25 there-through about a central axis. The outer surface 24 and the inner surface 26 may be radially spaced from one another to define a wall 27. The wall 27 may have a first end portion 28 and a second end portion 29 axially spaced form the first end portion 28.

The passageway 25 has a diameter configured to house a bearing assembly 12 having a first position wherein the bearing assembly 12 is disengaged from the marine diverter MD, and a second position wherein the bearing assembly 12 is engaged with and the marine diverter MD. The bearing assembly 12 includes a proximal end 16 and a distal end 17. The bearing assembly 12 may be mounted to the first end portion 28 and housed at least partially within the passageway 25, wherein the outer race 14 of the bearing assembly 12 may be configured to traverse the passageway 25. The first end portion 28 may include a flange 28*a*. Further, one or more bearing assembly(ies) 12 may be oriented in an inverted position, as is depicted in the FIGS. 2, 4 and 4*b*. The distal end 17 of the bearing assembly 12 may be housed within the passageway 25. The bearing assembly 12 may also be housed entirely within the passageway 25. The bearing assembly 12 may be configured to allow unobstructed flow through a flow channel 31 and out the diverter outlet 32.

The marine diverter MD system may further include an assembly for fastening 40 the flange 28*a* to the outer race 14. The assembly for fastening 40 may be optionally, by way of example, but not limited to: a clamp, a hydraulic clamp, a J-latch, a latching dog or internal-external threading.

The marine diverter MD system may also include a means for compiling data sensed by the device 50 and by the flow meter 60 in communication with both the device 50 and the flow meter 60 and a computational means for determining whether a kick or loss has occurred. The computational means may be configured to create a plot in the form of a graph.

The diverter flow line 62 may be connected to the marine housing 30 over a diverter outlet 32 and may also be connected to an accumulator 70. Said accumulator 70 may be a U-tube 72. The flow meter 60 may also be connected to the diverter flow line 62 downstream of the U-tube 72. Further, the diverter seal insert (or bearing assembly adaptor, as the case may be) 20 may also define a lubrication port 100 (see FIG. 2) through the wall 27.

Figure 2:
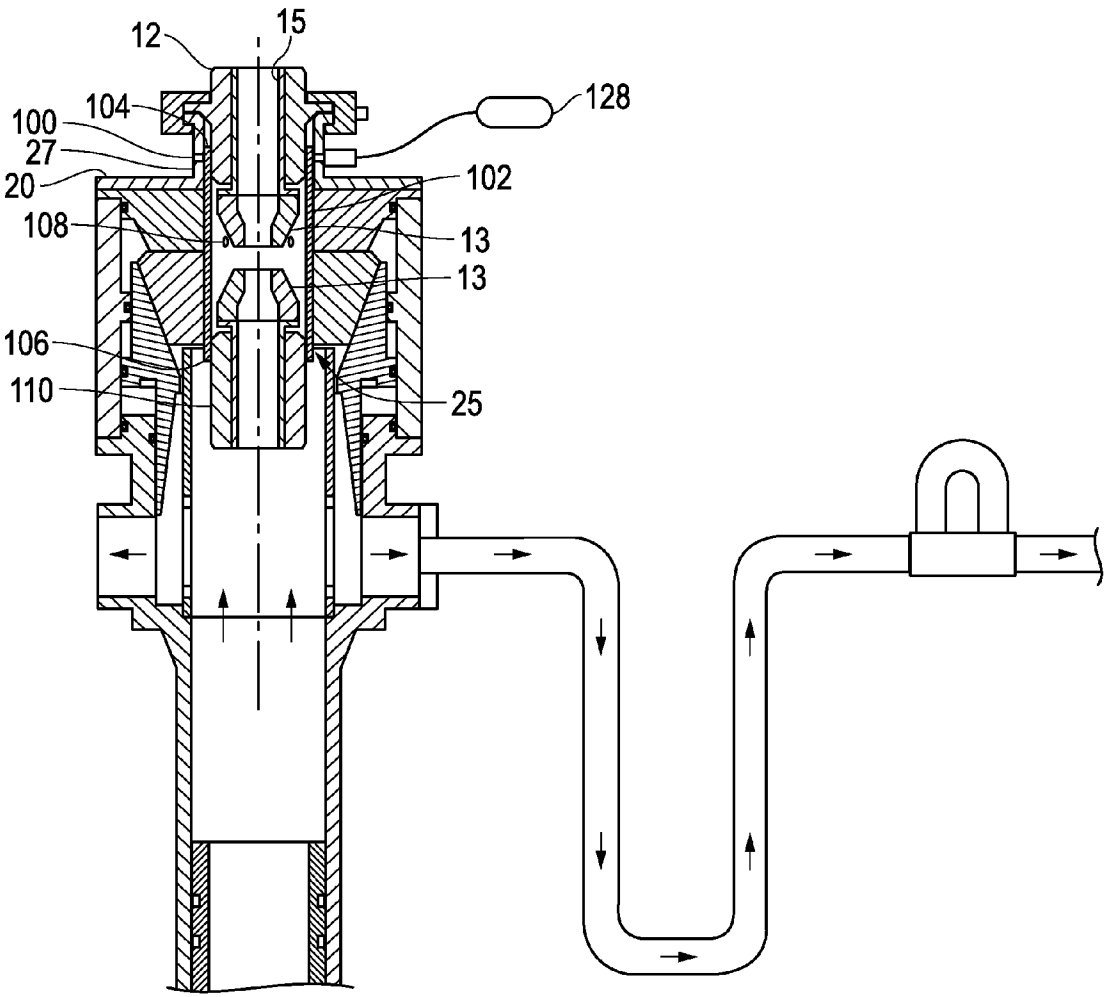
FIG. 2 depicts a schematic view of another embodiment of a marine diverter system.
Figure 3:
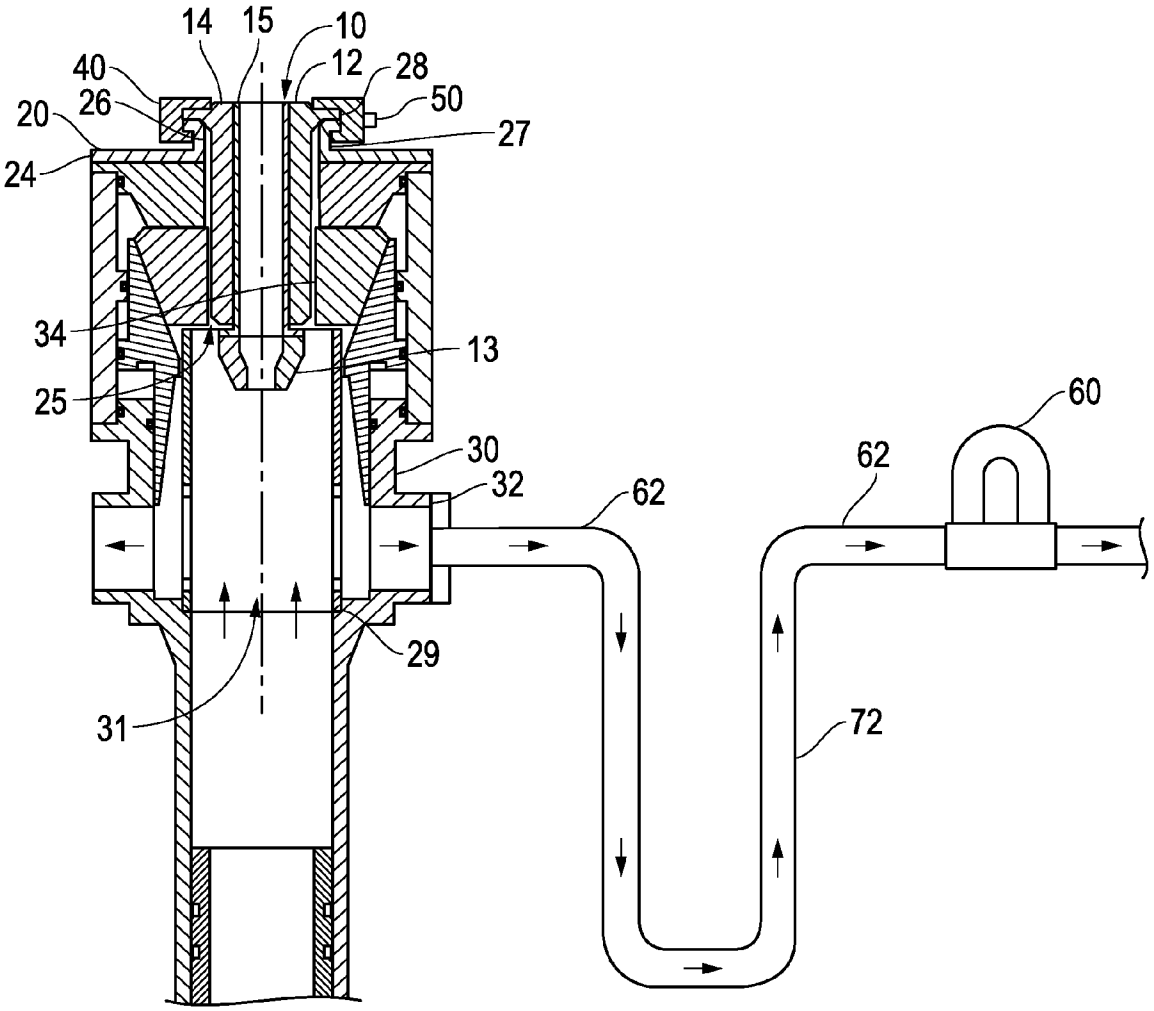
FIG. 3 depicts a schematic view of another embodiment of a marine diverter system.
Figure 3A:
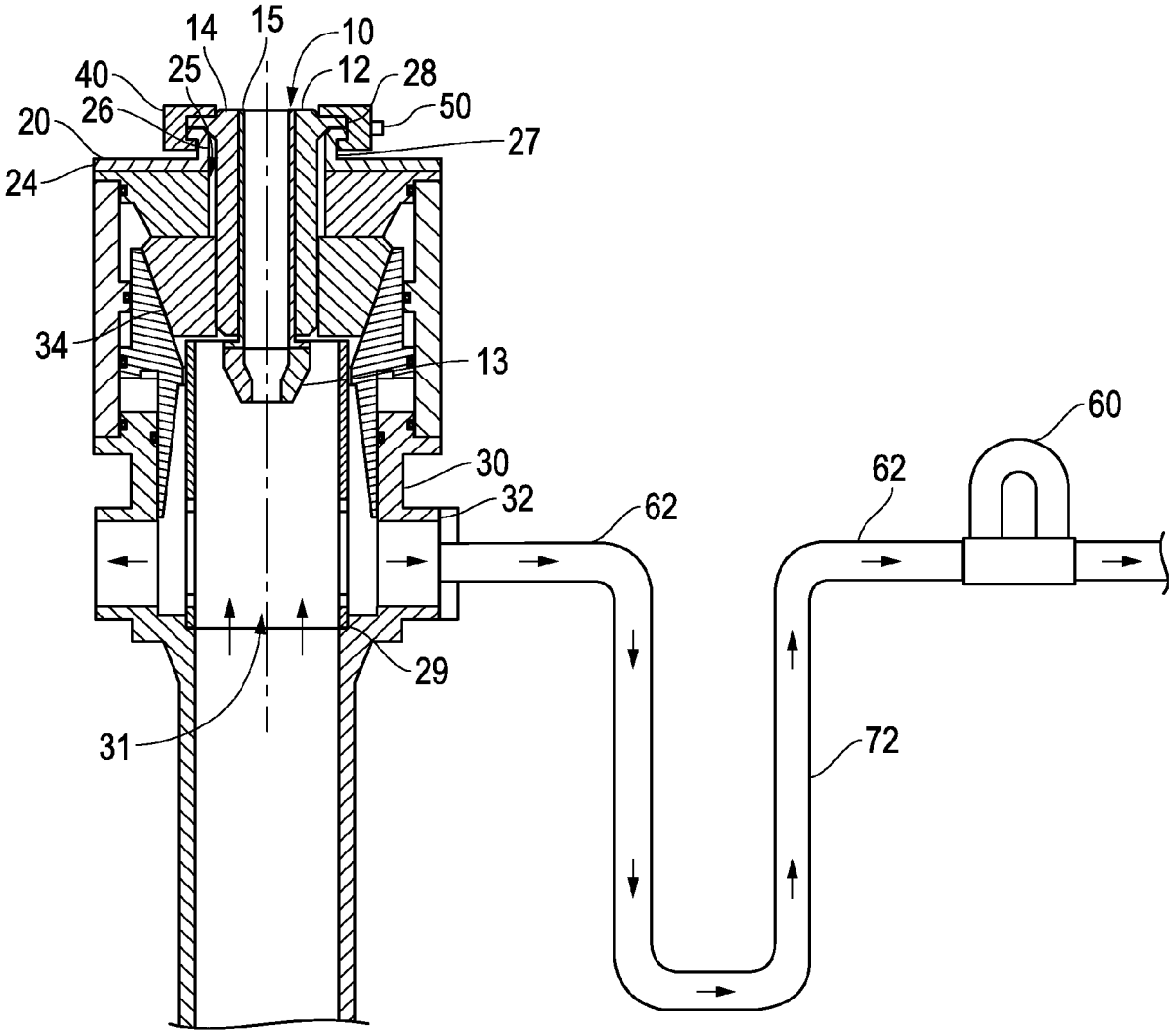
FIG. 3*a* is depicts a similar schematic view to FIG. 3 except that it shows annular packer seal (diverter seal) closed on the RCD/bearing assembly with rotatable seal(s) insert.

FIG. 2 also depicts a marine diverter MD system which further has a sleeve 102 connected at one end 104 to the bearing assembly 12 and extending axially into the passageway 25 below the bearing assembly 12; and a self-lubricated RCD 110 connected to another end 106 of the sleeve 102 within the passageway 25. The sleeve 102 may also be ported 108 proximate to a sealing portion of a rotatable seal(s) 13. The rotatable seal(s) 13 may be connected to an inner race 15 of the bearing assembly 12. Further, the bearing assembly 12 may form part of an RCD 10 mounted to the first end portion 28 (e.g. see FIGS. 3 and 3A), where the RCD 10 may be another self-lubricated RCD 110. The ports 100,108 may be, by way of example only, a lubrication or pressure port.

Figure 4:
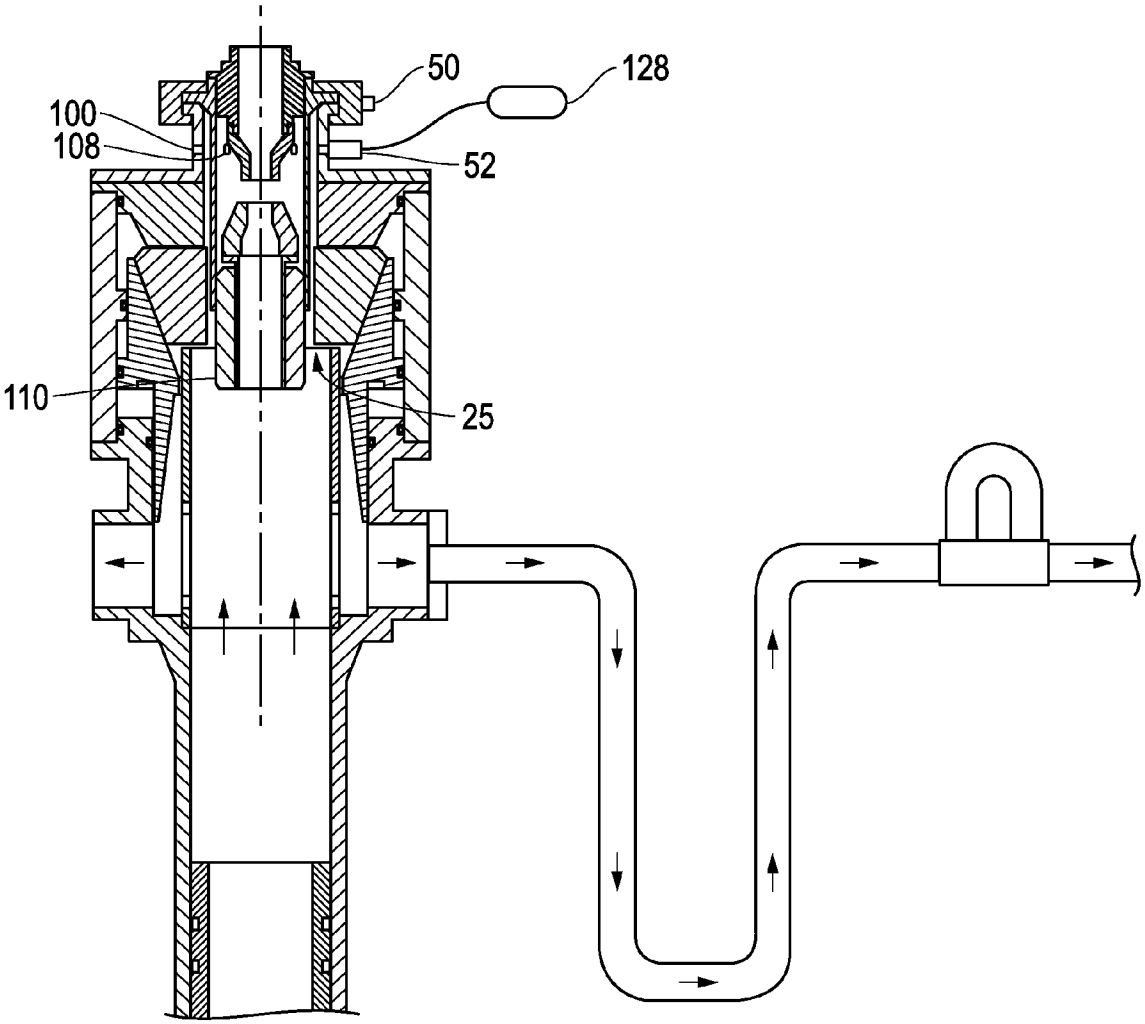
FIG. 4 depicts a schematic view of another embodiment of a marine diverter system.

FIG. 4 further depicts an accumulator (lubricator vessel) 128 which may function in conjunction with the lubrication port 100.

Figure 4A:
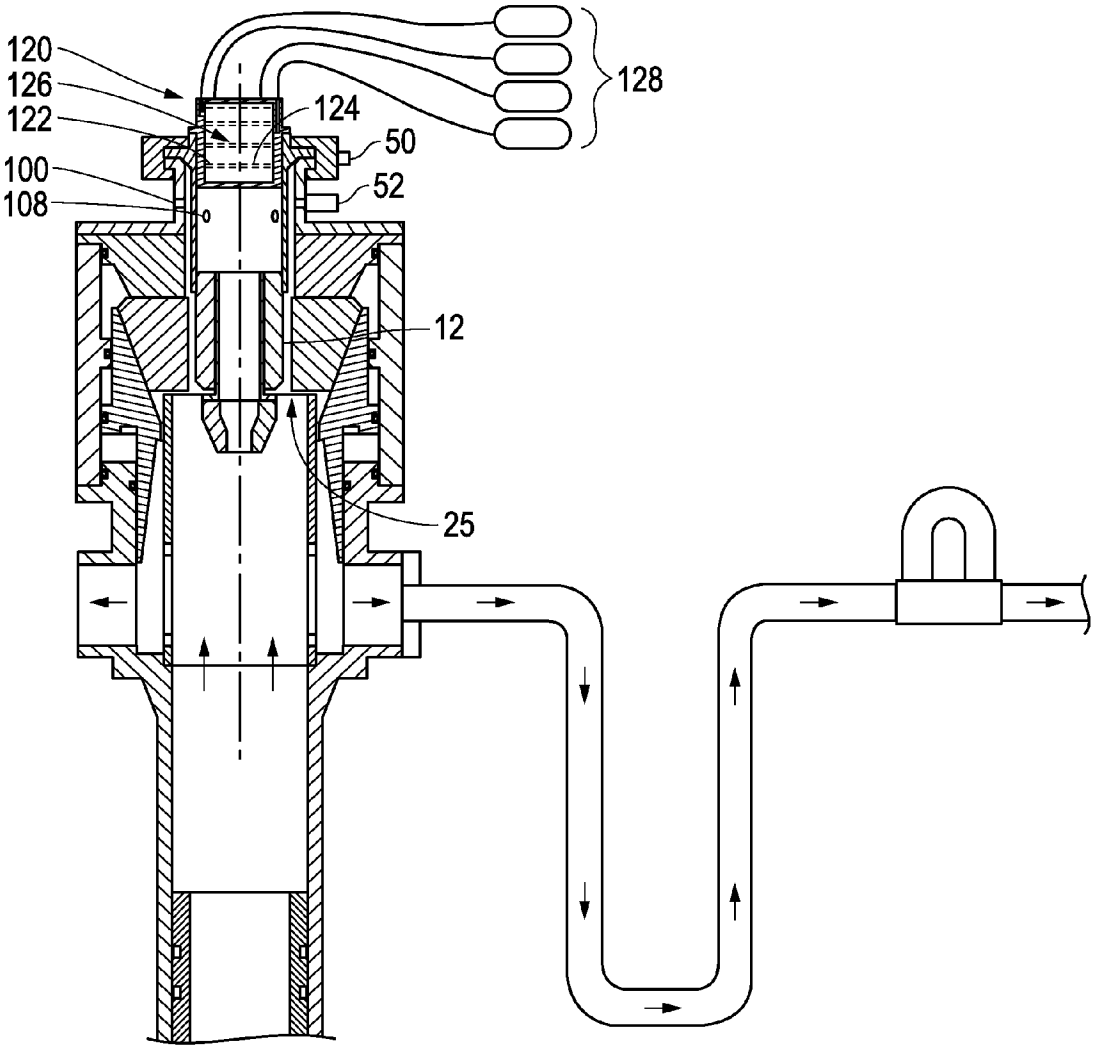
FIG. 4*a* depicts a schematic view of another embodiment of a marine diverter system.

FIG. 4*a* further depicts a cartridge 120 mounted above the bearing assembly 12 and at least partially within the passageway 25 and a plurality of wipers 122 contained within the cartridge 120, as part of the marine diverter MD system. The plurality of wipers 122 may include at least one packer 124 and further, the plurality of wipers 122 may define at least one annular space 126. The annular space 126 may be configured for lubrication and/or for pressure cascading. The marine diverter MD system may also include an accumulator 128 that is in fluid communication with the annular space 126.

Figure 4B:
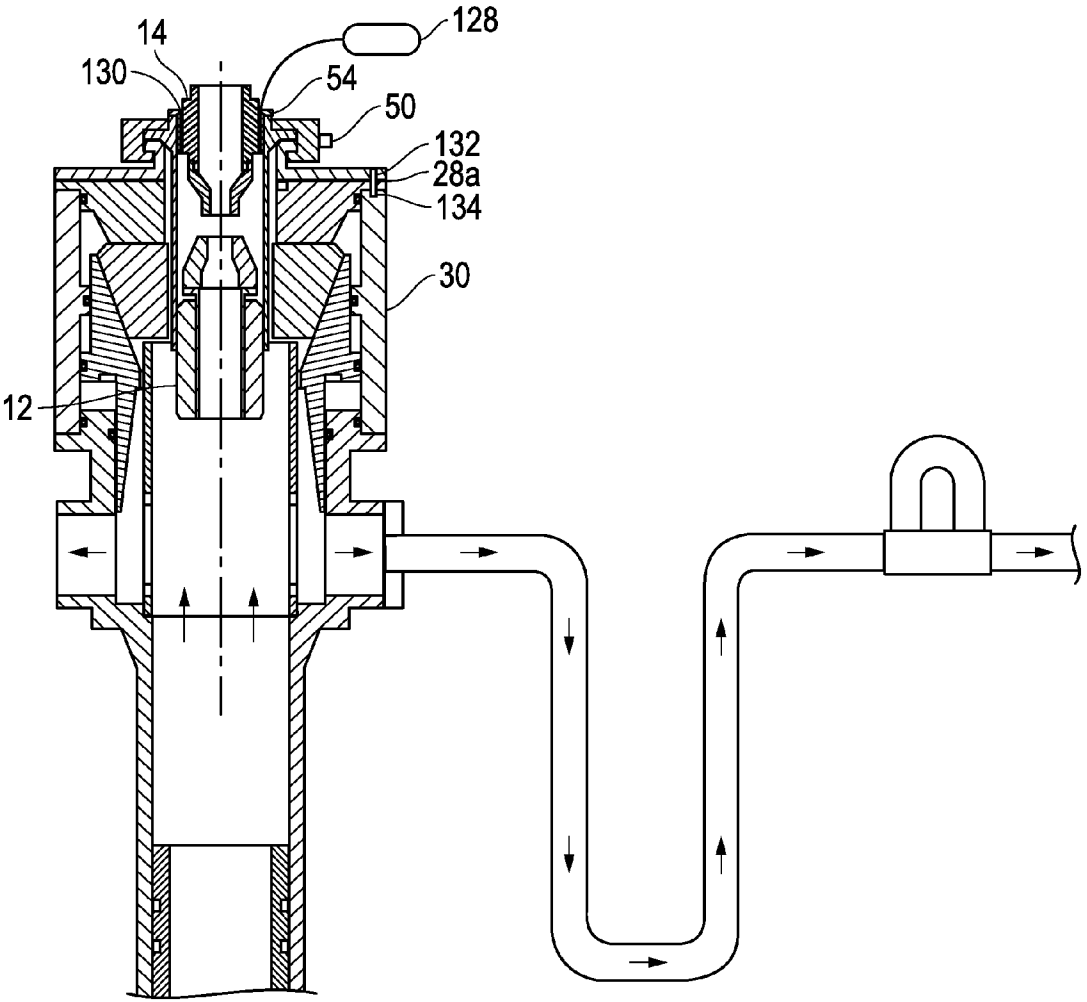
FIG. 4*b* depicts a schematic view of another embodiment of a marine diverter system.

FIG. 4*b* illustrates a bearing assembly 12 including an outer race 14, where the outer race 14 defines a plurality of radially spaced through-holes 130 extending parallel to the central axis. FIG. 4*b* also illustrates an inline pressure transducer 54 which may be a return from area between sealing elements. Additionally, as seen in FIG. 4*b*, the flange 28*a* may define a plurality of radially spaced bolt holes 132 which extend through and match a second plurality of radially spaced bolt holes 134 in the marine housing 30.

The bearing assembly 12 and the first end portion 28 may also be collectively configured to prevent the bearing assembly 12 from falling entirely through the passageway 25 into the marine housing 30 and potentially further.

The annular packer seal 34 of the marine housing 30 may be configured for operative and selective closing on the outer race 14 of the bearing assembly 12, for operative and selective closing on the sleeve 102, and/or for operative and selective closing on the drill string 8 and/or tool joint 9, i.e. the drill string 8 may be inclusive of a tool joint 9 (to selectively effect dual barrier protection) depending on the needs of the particular marine diverter MD system.

To convert a diverter used above a riser in the oilfield drilling industry between an open mud-return system and a closed and pressurized mud-return system, a bearing assembly 12 may first be traversed into a passageway 25 defined in a marine diverter housing 30 for avoiding interference with a rotary table tool of a drilling rig DR. The bearing assembly 12 may be fastened within and traverse to the passageway 25. The diverter flow line 62 exiting the diverter in a filled state may be maintained. A second bearing assembly 12 may be traversed into the passageway 25 in the marine diverter housing 30. The second bearing assembly 12 may be suspended via an outer race 14 within the passageway 25 and below the first bearing assembly 12.

To detect or infer kick-loss in the oilfield industry, data may be acquired as a first data set from a gyro accelerometer (or other device) 50 proximate a marine diverter MD. The first data set acquired from the gyro accelerometer (or other device) 50 may then be plotted as a wave function representing height or magnitude versus time in real time representing a first signature 140 of marine heave. Data is then acquired as a second data set from a flow meter 60 proximate the marine diverter MD and downstream of a telescoping slip joint 80. The second data set acquired from the flow meter 60 is plotted or calculated as part of a second wave function representing volumetric flow per unit measurement of time representing a second signature 160 for changes in volumetric flow over time downstream of a telescoping slip joint 80. The first signature 140 is then compared to the second signature 160 in order to detect a kick or loss from a well. Alternatively, the first data set and the second data set may be compared in order to detect a kick or loss from a well without plotting the respective data sets.

Figure 5:
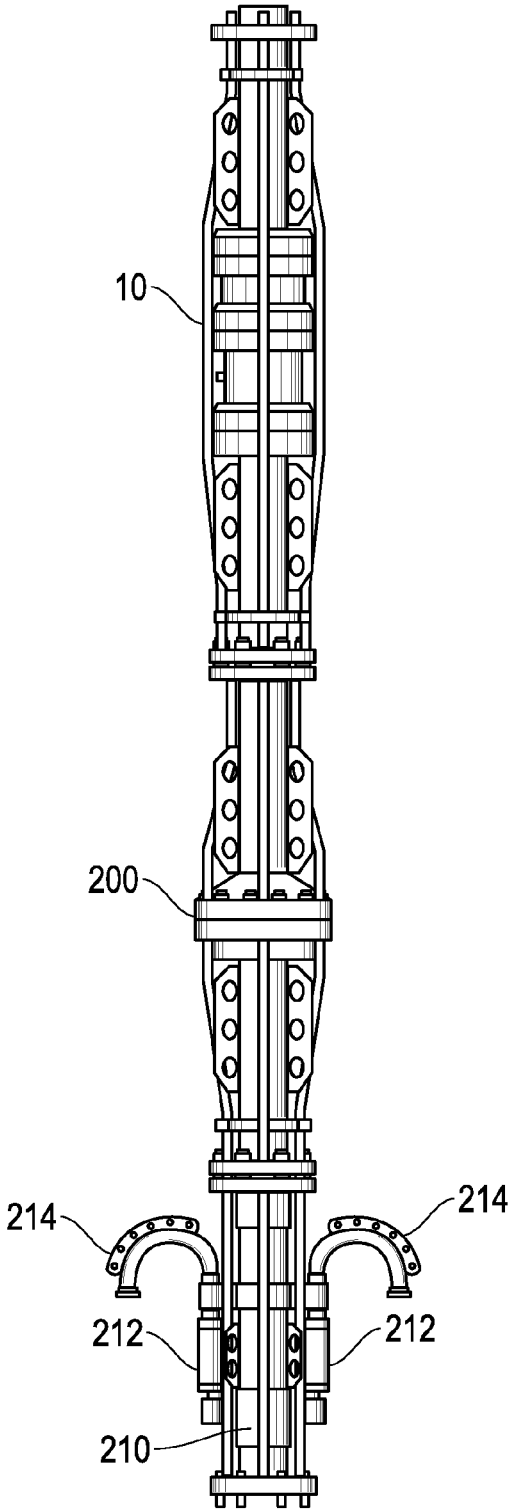
FIG. 5 depicts an elevation view of another embodiment employing the present improvements.

FIG. 5 depicts an alternative embodiment excluding the marine diverter MD wherein the RCD(s) 10 is located below the telescopic slip joint 80 (below the tension ring). The RCD 10 contains a seal 13. An annular BOP 200 in connected below the RCD 10. A flow spool 210 is connected below the annular BOP 200. The annular BOP 200 includes outlet(s) 214 with valve(s) 212. The outlet(s) 214 connect to the drilling rig DR or the like via diverter flow lines 62 (e.g. flexible hose). This embodiment may be used when making a connection, when locked relative to the drilling rig DR (or relative to the wellbore WB) to account for the swab/surge effect of the drilling rig DR which may result in a surge of volumetric flow when the drilling rig DR heaves. The data observed will be the same/similar as described herein with respect to the other embodiments. A continuous flow sub may also be incorporated as another working embodiment employing the improvements described and claimed herein.

Alternatives include that the rotatable sealing elements 13 may be actively or passively sealed as the case may be; a bearing assembly adaptor 22 may be needed, as the case may be; the embodiments disclosed may be used in various embodiments of marine drilling rigs DR (taught or reference by the art cited in the background). In the case of a closed diverter system, the drill string 8 with tool joints 9 may still be stripped in or out and/or with drilling through the rotatable inner race 15 and rotatable seals 13, without tearing seals, whilst operating for an early kick or loss detection.

While the exemplary embodiments are described with reference to various implementations and exploitations, it will be understood that these exemplary embodiments are illustrative and that the scope of the inventive subject matter is not limited to them. By way of example only, in another embodiment whereby pipe rotates relative to a non-rotating seal 13, the RCD(s) 10 may be replaced by a pressure control device 10*a*. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. An apparatus for use in the oilfield industry, the apparatus comprising:

a marine diverter having a longitudinal passageway and at least one diverter outlet;

an annular packer seal mounted within the marine diverter and surrounding the longitudinal passageway; and a first rotating control device including an outer race, a rotatable inner race, and at least one rotatable seal which extends axially beyond the outer race, wherein the outer race of the first rotating control device is at least partially inserted into the longitudinal passageway, and wherein the annular packer seal displaces radially inward into sealing engagement with the outer race of the first rotating control device.

2. The apparatus according to claim 1, wherein the first rotating control device is oriented in an inverted position.

3. The apparatus according to claim 1, wherein the first rotating control device is housed entirely within the longitudinal passageway.

4. The apparatus according to claim 1, wherein the first rotating control device is configured to allow unobstructed flow through a flow channel and out the diverter outlet.

5. The apparatus according to claim 1, further comprising an assembly for fastening the outer race to the marine diverter, wherein the assembly for fastening is selected from the group consisting of a clamp, a hydraulic clamp, a J-latch, a latching dog and internal-external threading.

6. The apparatus according to claim 1, further comprising a device configured to measure vertical displacement of the marine diverter; and a flow meter mounted to a diverter flow line connected to the diverter outlet.

7. The apparatus according to claim 1, further comprising a diverter flow line connected to the diverter outlet; and an accumulator connected to the diverter flow line.

8. The apparatus according to claim 7, wherein the accumulator is a U-tube.

9. The apparatus according to claim 8, further comprising a flow meter connected to the diverter flow line downstream of the U-tube.

10. The apparatus according to claim 1, further comprising a diverter seal insert, wherein the diverter seal insert includes a lubrication port.

11. The apparatus according to claim 1, further comprising:

a cartridge mounted above the first rotating control device;

a plurality of wipers contained within the cartridge;

wherein the plurality of wipers comprise at least one packer; and wherein the plurality of wipers define at least one annular space.

12. The apparatus according to claim 11, wherein the annular space is configured for lubrication.

13. The apparatus according to claim 12, wherein the annular space is configured for pressure cascading.

14. The apparatus according to claim 11, wherein the annular space is configured for pressure cascading.

15. The apparatus according to claim 12, further comprising an accumulator in fluid communication with the annular space.

16. The apparatus according to claim 13, further comprising an accumulator in fluid communication with the annular space.

17. The apparatus according to claim 10, wherein the diverter seal insert includes a plurality of radially spaced through-holes extending parallel to a central axis of the diverter seal insert.

18. The apparatus according to claim 17, wherein the diverter seal insert comprises a flange and the flange includes the plurality of radially spaced through-holes which match a second plurality of radially spaced bolt holes in the marine diverter.

19. The apparatus according to claim 1, wherein the outer race is configured to prevent the rotating control device from falling entirely through the longitudinal passageway.

20. An apparatus for use in the oilfield industry, the apparatus comprising:

a marine diverter having a longitudinal passageway and at least one diverter outlet;

an annular packer seal mounted within the marine diverter and surrounding the longitudinal passageway;

a first rotating control device including an outer race, a rotatable inner race, and at least one rotatable seal which extends axially beyond the outer race;

a sleeve connected at one end to the outer race and extending axially into the longitudinal passageway below the first rotating control device; and a second rotating control device connected to an opposite end of the sleeve, wherein the annular packer seal displaces radially inward into sealing engagement with the sleeve.

21. The apparatus according to claim 20, wherein the sleeve is ported proximate to a sealing portion of the rotatable seal, the rotatable seal being connected to the inner race of the first rotating control device.

* * * * *